US011473833B1

(12) United States Patent
Brown

(10) Patent No.: US 11,473,833 B1
(45) Date of Patent: Oct. 18, 2022

(54) LOW-PROFILE REFRIGERATOR/FREEZER

(71) Applicant: Marshall L. Brown, Canton, OH (US)

(72) Inventor: Marshall L. Brown, Canton, OH (US)

( * ) Notice: Subject to any disclaimer, the term of this patent is extended or adjusted under 35 U.S.C. 154(b) by 0 days.

(21) Appl. No.: 17/494,174

(22) Filed: Oct. 5, 2021

Related U.S. Application Data

(60) Provisional application No. 63/204,442, filed on Oct. 5, 2020.

(51) Int. Cl.
*F25D 23/02* (2006.01)
*F25D 11/02* (2006.01)
*F25D 25/02* (2006.01)

(52) U.S. Cl.
CPC ..... *F25D 23/028* (2013.01); *F25D 11/025* (2013.01); *F25D 25/025* (2013.01); *F25D 2323/021* (2013.01); *F25D 2400/38* (2013.01)

(58) Field of Classification Search
CPC .... F25D 23/028; F25D 11/025; F25D 25/025; F25D 2323/021; F25D 2400/38; F25D 11/02
See application file for complete search history.

(56) References Cited

U.S. PATENT DOCUMENTS 2,443,787 A 6/1948 Earle
2,490,494 A 12/1949 Widman
2,970,450 A * 2/1961 Roeder, Jr. ..... F25B 21/02 62/3.6
6,564,570 B2 5/2003 Koike et al.
8,002,368 B2 8/2011 Benitsch et al.
9,157,674 B2 10/2015 Collins et al.
10,378,816 B2 8/2019 Delgadillo
10,485,341 B2 11/2019 Dash et al.
2005/0236947 A1* 10/2005 LeClear ..... A47B 77/08 312/404
2006/0238084 A1* 10/2006 Golani ..... F25D 25/04 312/268
2007/0138925 A1* 6/2007 Fu ..... F25D 23/069 312/401
2007/0180849 A1* 8/2007 Walker ..... F25D 11/006 62/407
2013/0111936 A1* 5/2013 Olson ..... F25D 23/028 62/127
2015/0253060 A1* 9/2015 Borise ..... F25D 23/021 312/405

* cited by examiner

*Primary Examiner* — David J Teitelbaum
(74) *Attorney, Agent, or Firm* — Cramer Patent & Design, PLLC; Aaron R. Cramer

(57) ABSTRACT

The present invention is directed to a low-profile refrigerator/freezer. The refrigerator/freezer may comprise a housing, a refrigerator door, a freezer door, divider walls, operator controls, and a refrigeration subsystem. The refrigerator/freezer may be adapted for use by a wheelchair-bound user. The housing may be less than or equal to 38 inches high, less than or equal to 42 inches wide, and less than or equal to 18 inches deep such that the wheelchair-bound user may be able to reach an interior space of the refrigerator/freezer from a wheelchair. A refrigerator compartment and a freezer compartment may be side-by-side such that the refrigerator compartment and the freezer compartment provide the same visibility. The operator controls may be placed within reach of the wheelchair-bound user. The refrigerator/freezer may be mounted on a plurality of caster wheels. Two front wheels may comprise brakes for safety.

12 Claims, 8 Drawing Sheets

LOW-PROFILE REFRIGERATOR/FREEZER

RELATED APPLICATIONS

The present invention was first described in and claims the benefit of U.S. Non-Provisional Application No. 63/204,442, the entire disclosures of which are incorporated herein by reference.

FIELD OF THE INVENTION

The present invention relates generally to a refrigerator/freezer and more specifically to a low-profile refrigerator/freezer.

BACKGROUND OF THE INVENTION

People with physical disabilities, such as the elderly, the handicapped, or those recovering from injuries or surgery know all too well of some of the difficulties that they encounter while performing tasks that most of us take for granted. What comes easily to those that are not physically challenged, such as climbing stairs or dressing themselves, requires extreme physical exertion or, worse yet, is altogether impossible to accomplish without assistance.

For those confined to a wheelchair, the simple act of getting something out of the refrigerator becomes impossible should the needed item be on a top shelf or in the back area of a lower shelf. This forces reliance on others to assist, thus reducing the user's independence and ability to live on their own. Accordingly, there exists a need for a means by which refrigerator access can be more easily provided to users of wheelchairs in a manner that address the above-mentioned difficulties. The development of the low-profile refrigerator/freezer fulfills this need.

SUMMARY OF THE INVENTION

The principles of the present invention provide for a low-profile refrigerator/freezer has a housing having a refrigerator compartment and a freezer compartment disposed side-by-side in an interior space of the housing, a refrigerator door which covers the refrigerator compartment, a freezer door which covers the freezer compartment, a vertical compartment which separates having a vertically-oriented divider located between the refrigerator compartment and the freezer compartment, a plurality of operator controls which is adapted to be disposed within reach of a wheelchair-bound user and a refrigeration subsystem packaged within the housing. The four caster wheels disposed on each bottom corner of the housing to allow relocating the low-profile refrigerator/freezer. the refrigerator compartment refrigerates a plurality of food and beverages placed within the refrigerator compartment, the freezer compartment freezes the food placed within the freezer compartment, and the refrigerator compartment includes one or more horizontal refrigerator dividers. The operator controls establish predetermined temperatures within the refrigerator compartment and the freezer compartment.

The housing may be a hollow and open-front rectangular prism. The housing may be less than or equal to 38 inches high, less than or equal to 42 inches wide, and less than or equal to 18 inches deep such that the wheelchair-bound user reaches an interior space of the low-profile refrigerator/freezer from a wheelchair. The refrigerator compartment may cool the food and beverages to a temperature between 40° F. and the freezer compartment cools the food and beverages to a temperature below 32° F. The at least one vertical space may be operable to store a 1 Gallon container of milk and/or a bottle of juice. The one or more horizontal refrigerator dividers may be operable as one or more shelves upon which the food and beverages is stored. The one or more shelves slides into and out of the housing for cleaning and/or access to the food and beverages stored on the at least one slide-out shelf.

The refrigerator door may be hingedly coupled to the housing via one or more refrigerator door hinges and the refrigerator door pivots open to provide access to a plurality of contents of the refrigerator compartment and pivot closed to retain a temperature within the refrigerator compartment. A refrigerator door may include a refrigerator door handle that is adapted to be grasped by the wheelchair-bound user to open or close the refrigerator door.

The refrigerator compartment may include one or more vertical refrigerator dividers having at least one vertical drawer separator includes a divider and guide for a first drawer and a second drawer. The first drawer and the second drawer are made of glass or clear plastic that does not block visibility of the food and beverages. The freezer door may be hingedly coupled to the housing via one or more freezer door hinges and the freezer door pivots open to provide access to a plurality of contents of the freezer compartment and pivot closed to retain a temperature within the freezer compartment. The freezer door includes a freezer door handle that may be adapted to be grasped by the wheelchair-bound user to open or close the freezer door. The housing, the refrigerator door, the freezer door, or combinations thereof may be made of stainless steel. The vertical compartment separator may be aligned with a boundary between the refrigerator door and the freezer door such that opening the refrigerator door exposes only the refrigerator compartment and opening the freezer door exposes only the freezer compartment.

The refrigeration subsystem may include mechanical refrigeration. The mechanical refrigeration may include a compressor, a condenser, an expansion valve, and an evaporator operating as a closed-loop system. The refrigeration subsystem may include a solid-state refrigeration. The solid state refrigeration may include one or more thermoelectric coolers that utilize a Peltier effect to create heat and cold. A front two caster wheels of the four caster wheels may include a brake to stop the front two caster wheels for safety.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
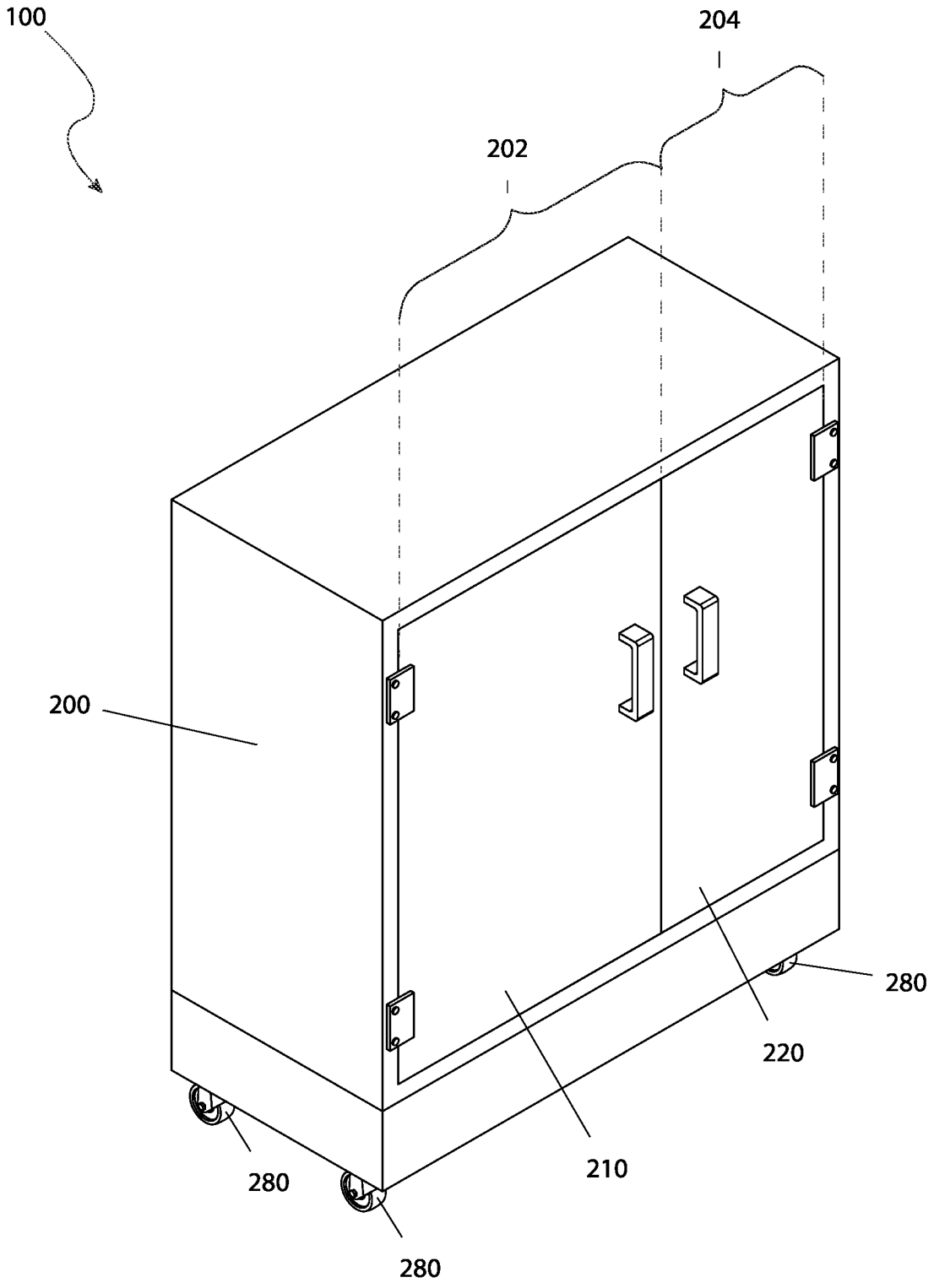
FIG. 1 is a front overhead isometric view of a low-profile refrigerator/freezer, according to an embodiment of the present invention.
Figure 2:
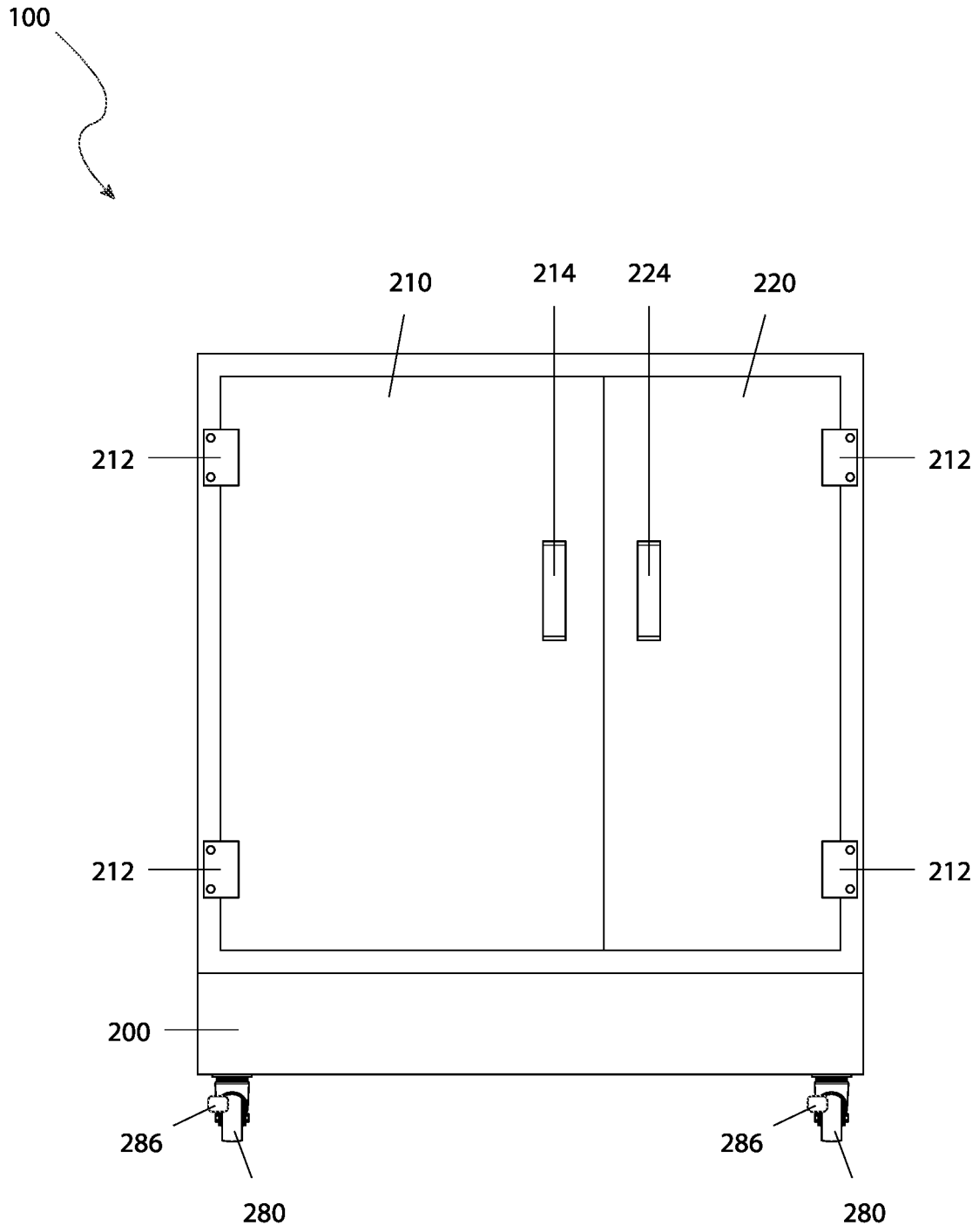
FIG. 2 is a front view of a low-profile refrigerator/freezer, according to an embodiment of the present invention.
Figure 3:
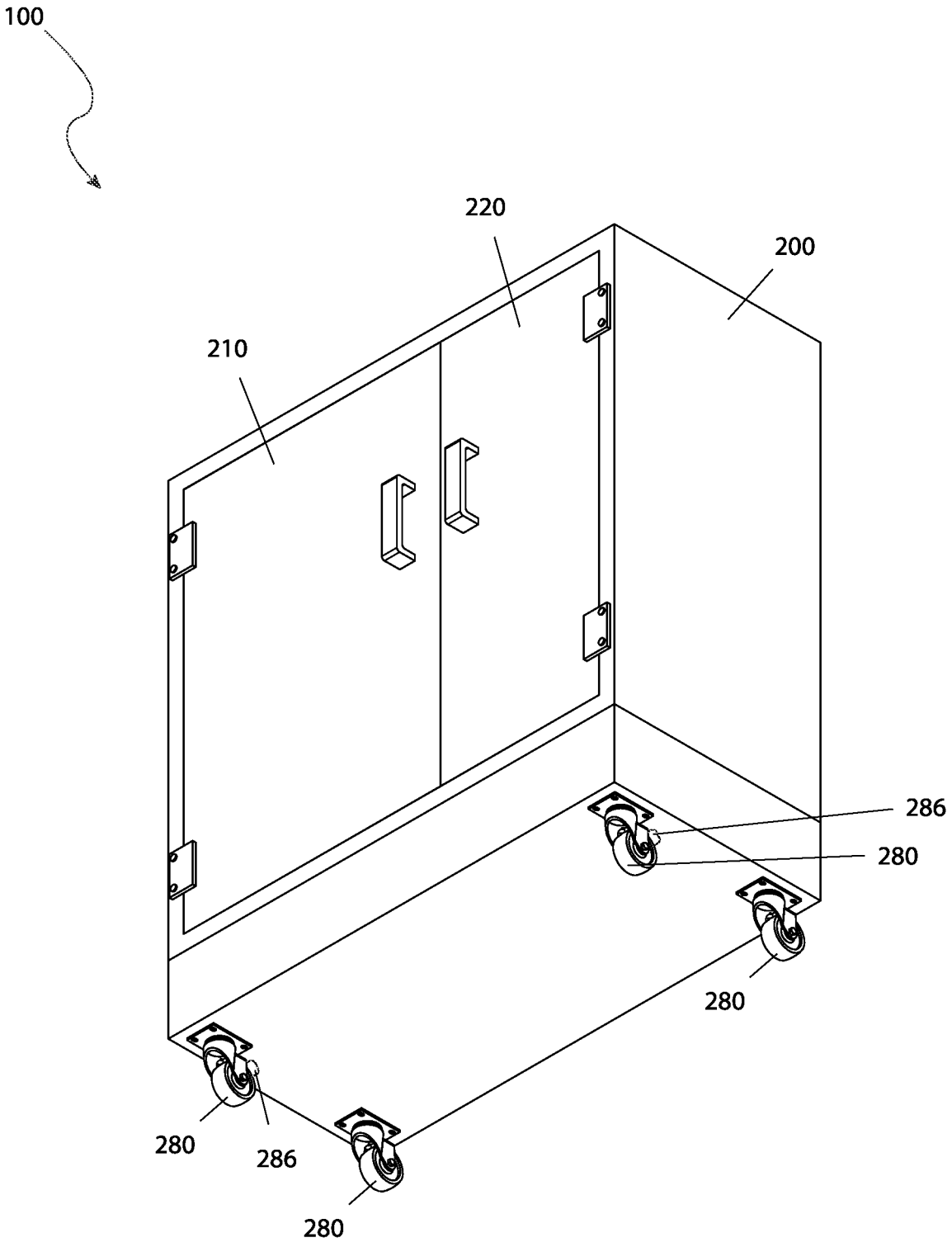
FIG. 3 is a front isometric view of a low-profile refrigerator/freezer, according to an embodiment of the present invention illustrating underside details.
Figure 4:
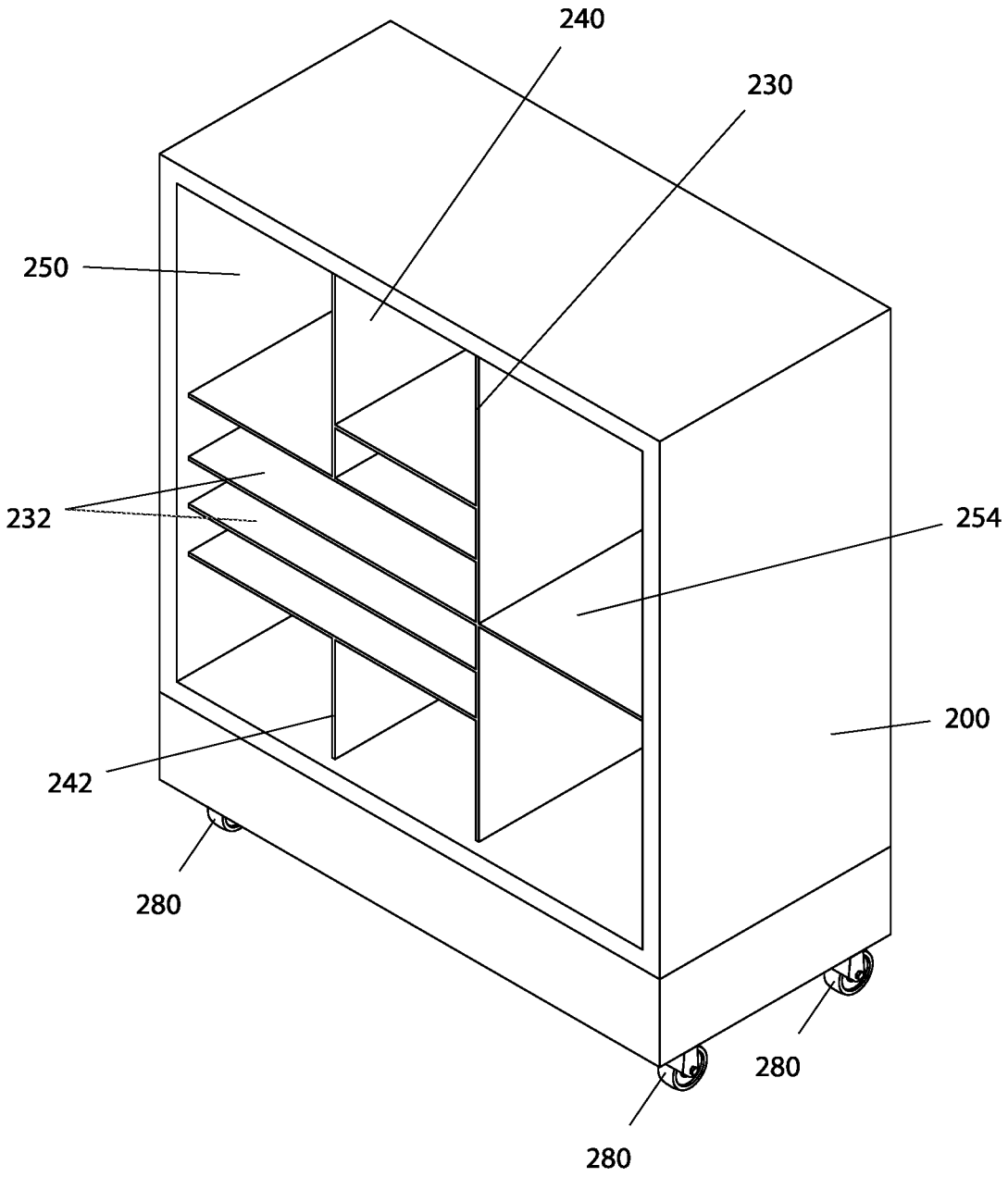
FIG. 4 is a front isometric view of a low-profile refrigerator/freezer, according to an embodiment of the present invention illustrating the doors removed to show divider details.
Figure 5:
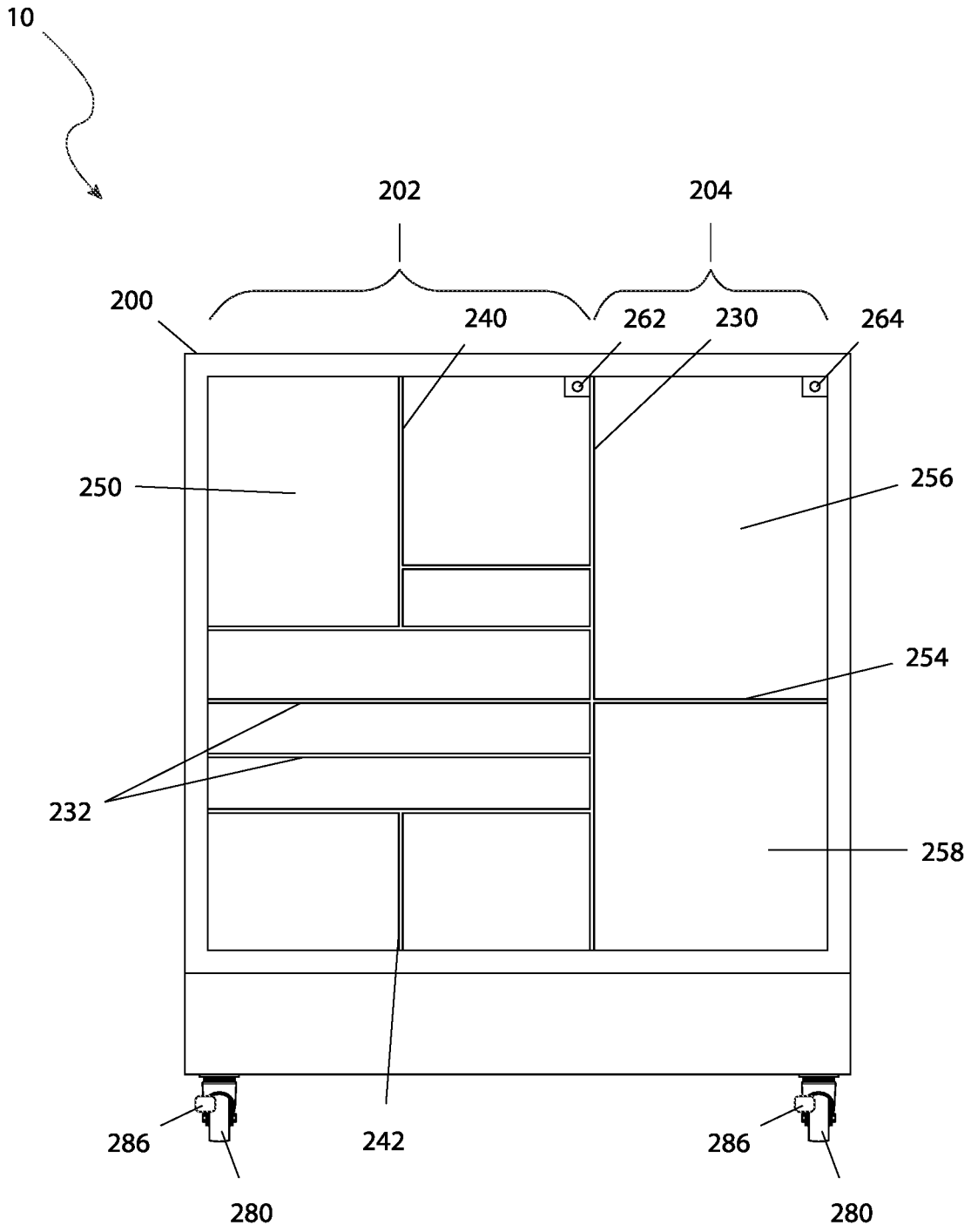
FIG. 5 is a front view of a low-profile refrigerator/freezer, according to an embodiment of the present invention illustrating the doors removed to show divider details.
Figure 6:
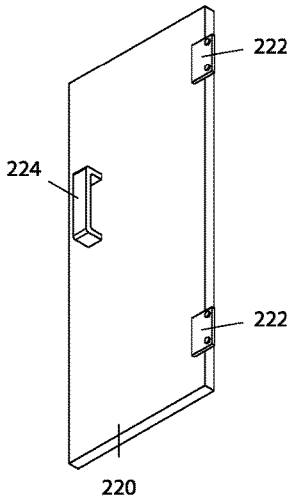
FIG. 6 is an isometric view of a low-profile refrigerator/freezer, according to an embodiment of the present invention illustrating a single door.
Figure 7:
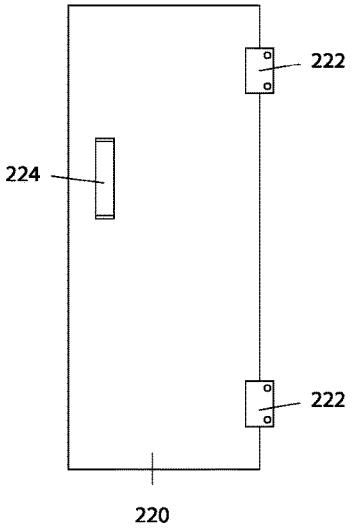
FIG. 7 is a front view of a low-profile refrigerator/freezer, according to an embodiment of the present invention illustrating a single door.
Figure 8:
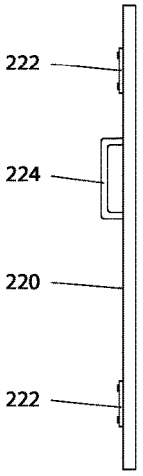
FIG. 8 is a side view of a low-profile refrigerator/freezer, according to an embodiment of the present invention illustrating a single door.
Figure 9:
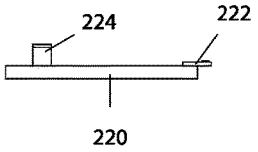
FIG. 9 is a bottom view of a low-profile refrigerator/freezer, according to an embodiment of the present invention illustrating a single door.
Figure 10:
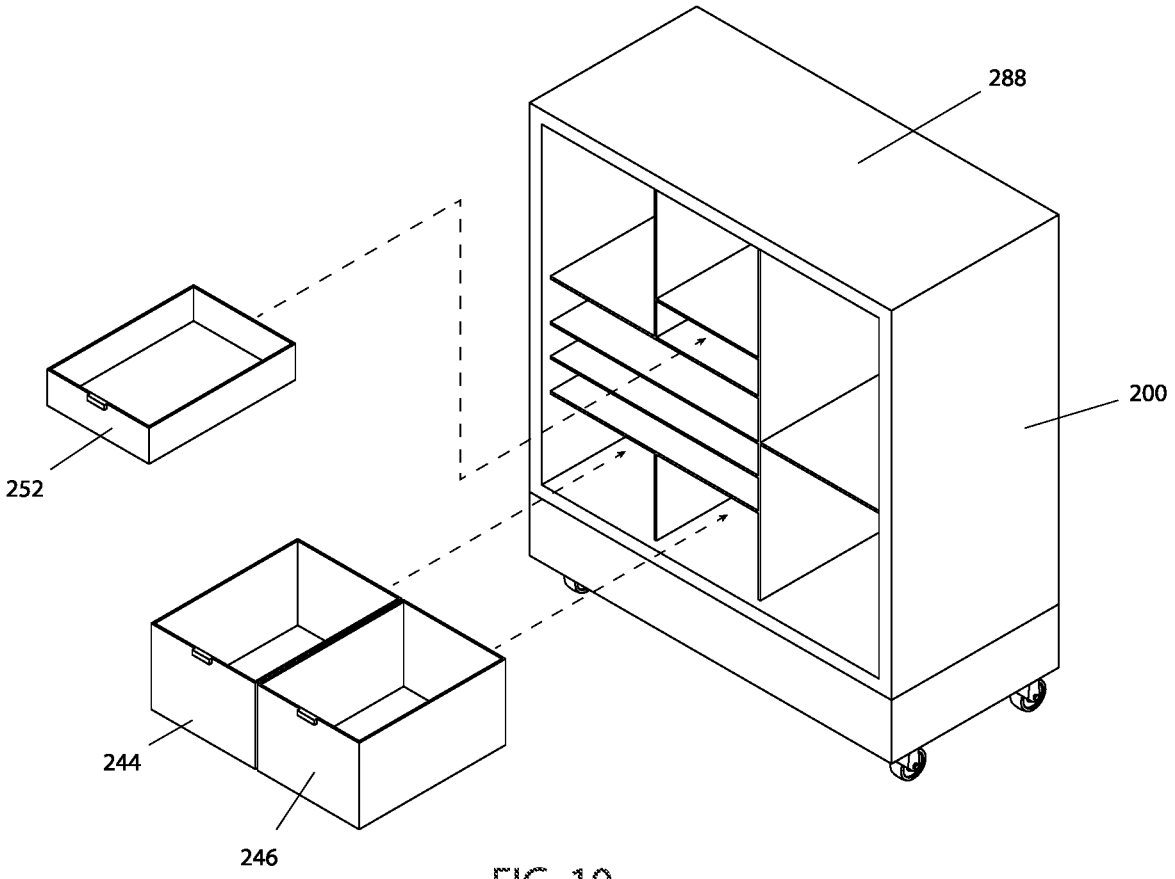
FIG. 10 is a front isometric view of a low-profile refrigerator/freezer, according to an embodiment of the present invention illustrating placement of the drawers.
Figure 11:
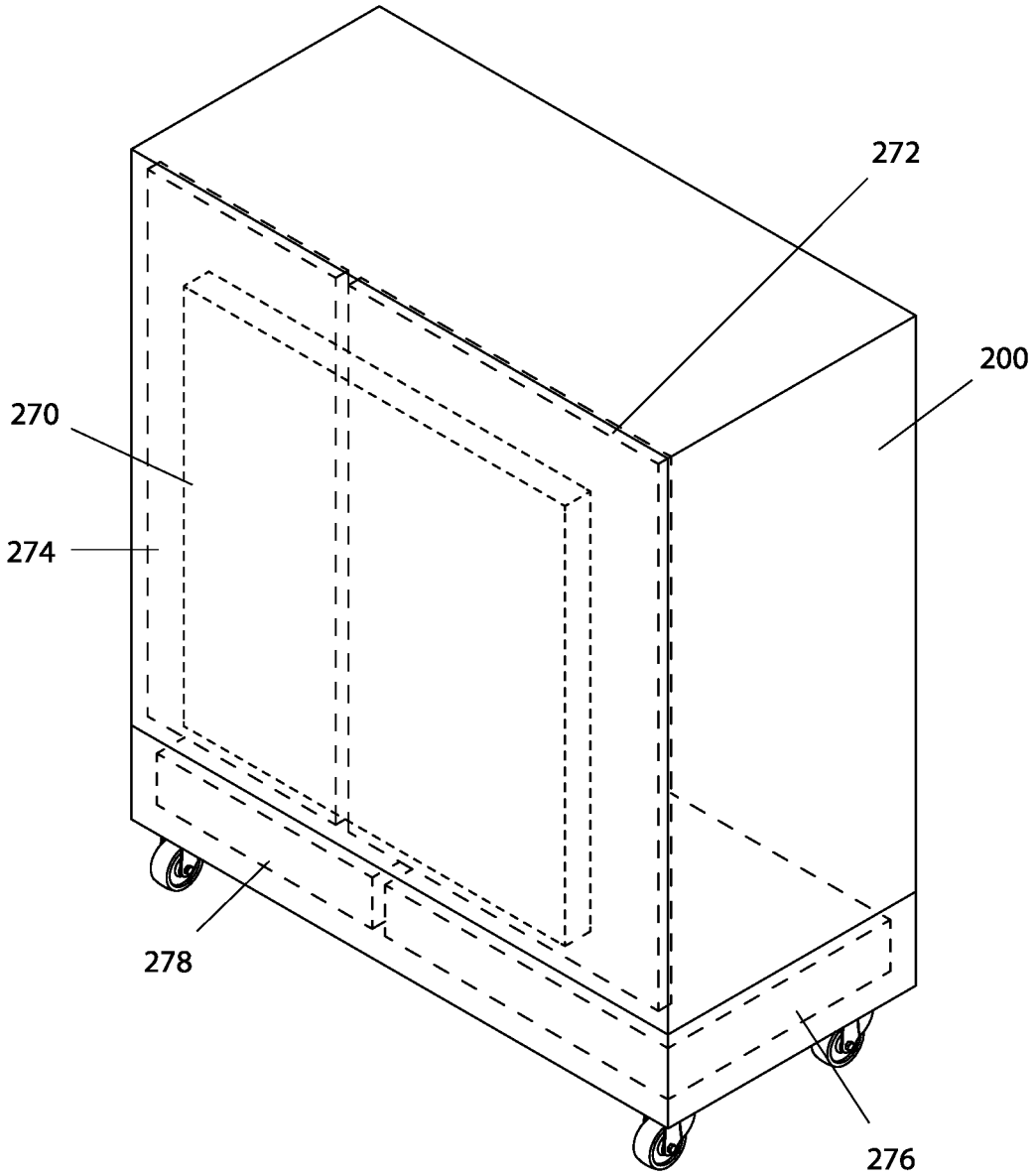
FIG. 11 is a rear isometric view of a low-profile refrigerator/freezer, according to an embodiment of the present invention illustrating placement of the refrigeration subsystem.

100 low-profile refrigerator/freezer
200 housing
202 refrigerator compartment
204 freezer compartment
210 refrigerator door
212 refrigerator door hinge
214 refrigerator door handle
220 freezer door
222 freezer door hinges
224 freezer door handle
230 vertical compartment separator
232 horizontal refrigerator divider
240 vertical refrigerator divider
242 vertical drawer separator
244 first drawer
246 second drawer
250 vertical space
252 third drawer
254 horizontal freezer divider
256 upper freezer space
258 lower freezer space
262 refrigerator temperature control
264 freezer temperature control
270 refrigeration sub system
272 rear wall behind the refrigerator compartment
274 rear wall behind the freezer compartment
276 space under the refrigerator compartment
278 space under the freezer compartment
280 caster wheel
286 brake
288 top surface

DESCRIPTION OF THE INVENTION

The present invention is directed to a low-profile refrigerator/freezer (herein described as the "invention") 100. The invention 100 may comprise a housing 200, a refrigerator door 210, a freezer door 220, divider walls, operator controls, and a refrigeration subsystem 270. The invention 100 may be adapted for use by a wheelchair-bound user. The housing 200 may be less than or equal to thirty-eight inches (38 in.) high, less than or equal to forty-two inches (42 in.) wide, and less than or equal to eighteen inches (18 in.) deep such that the wheelchair-bound user may be able to reach an interior space of the invention 100 from a wheelchair. A refrigerator compartment 202 and a freezer compartment 204 may be side-by-side such that the refrigerator compartment 202 and the freezer compartment 204 provide the same visibility. The operator controls may be placed within reach of the wheelchair-bound user. The invention 100 may be mounted on a plurality of caster wheels 280 such that the invention 100 may be relocated. Two (2) front wheels may comprise brakes 286 for safety.

The housing 200 may be a hollow, open-front rectangular prism. The interior space of the housing 200 may comprise the refrigerator compartment 202 and the freezer compartment 204. The refrigerator compartment 202 and the freezer compartment 204 may be located laterally adjacent to each other. The invention 100 may cool the refrigerator compartment 202 to refrigerate food and beverages placed within the refrigerator compartment 202. The invention 100 may cool the freezer compartment 204 to freeze food placed within the freezer compartment 204. In a preferred embodiment, the refrigerator compartment 202 may cool the food and beverages to a temperature between forty degrees F. (40° F.) and the freezer compartment 204 may cool the food and beverages to a temperature below thirty-two degrees F. (32° F.). Ideally, the freezer compartment 204 may cool the food to a temperature of zero degrees F. (0° F.).

The refrigerator compartment 202 may be covered by the refrigerator door 210. The refrigerator door 210 may be hingedly coupled to the housing 200 via refrigerator door hinges 212. The refrigerator door 210 may pivot open to provide access to the contents of the refrigerator compartment 202 and may pivot closed to retain the temperature within the refrigerator compartment 202. The refrigerator door 210 may comprise a refrigerator door handle 214 that may be adapted to be grasped by the wheelchair-bound user to open or close the refrigerator door 210.

The freezer compartment 204 may be covered by the freezer door 220. The freezer door 220 may be hingedly coupled to the housing 200 via freezer door hinges 222. The freezer door 220 may pivot open to provide access to the contents of the freezer compartment 204 and may pivot closed to retain the temperature within the freezer compartment 204. The freezer door 220 may comprise a freezer door handle 224 that may be adapted to be grasped by the wheelchair-bound user to open or close the freezer door 220.

The divider walls that may divide the interior space of the housing 200. A vertical compartment separator 230 may be a vertically-oriented divider located between the refrigerator compartment 202 and the freezer compartment 204. The vertical compartment separator 230 may be aligned with a boundary between the refrigerator door 210 and the freezer door 220 such that opening the refrigerator door 210 exposes only the refrigerator compartment 202 and opening the freezer door 220 exposes only the freezer compartment 204.

The refrigerator compartment 202 may comprise one (1) or more horizontal refrigerator dividers 232. The one (1) or more horizontal refrigerator dividers 232 may be operable as shelves upon which the food and beverages may be stored. The one (1) or more horizontal refrigerator dividers 232 may comprise at least one slide-out shelf. The at least one (1) slide-out shelf may slide into and out of the housing 200 for cleaning and/or access to the food and beverages stored on the at least one (1) slide-out shelf.

The refrigerator compartment 202 may comprise one (1) or more vertical refrigerator dividers 240. The one (1) or more vertical refrigerator dividers 240 may comprise at least one (1) vertical drawer separator 242. The at least one (1) vertical drawer separator 242 may be a divider and guide for a first drawer 244 and a second drawer 246.

The first drawer 244 and the second drawer 246 may be open-top drawers for holding meat and vegetables. Generally, the meat may be stored in the first drawer 244 and the vegetables may be stored in the second drawer 246, or vice versa. In a preferred embodiment, an individual drawer selected from the first drawer 244 and the second drawer 246 may be at least eleven and one-half inches (11½ in.) wide and at least eight inches (8 in.) high.

The refrigerator compartment 202 may comprise at least one vertical space 250 that may be at least fifteen inches (15 in.) tall and at least ten inches (10 in.) wide. The at least one (1) vertical space 250 may be operable to store a one-gallon (1 Gal.) container of milk and/or a bottle of juice.

In some embodiments, the refrigerator compartment 202 may comprise a third drawer 252 that may be at least ten inches (10 in.) wide and no more than four inches (4 in.) high. The third drawer 252 may be operable to store sliced lunch meat, sliced cheese, and other thin food products.

A freezer side may comprise at least one horizontal freezer divider 254. The freezer compartment 204 may comprise the at least one (1) horizontal freezer divider 254. The at least one (1) horizontal freezer divider 254 may divide the freezer compartment 204 into an upper freezer space 256 and a lower freezer space 258. The at least one (1) horizontal freezer divider 254 may enable the removal of items stored in the lower freezer space 258 without having to move items that are stored in the upper freezer space 256.

In a preferred embodiment, the divider walls, the first drawer 244, the second drawer 246, and the third drawer 252 may be made of glass or clear plastic such that the divider walls and drawers do not block the visibility of the food and beverages stored within the invention 100.

The operator controls may establish predetermined temperatures within the refrigerator compartment 202 and the freezer compartment 204. The predetermined temperature may be the desired operating temperature for the refrigerator compartment 202 or the freezer compartment 204. The operator controls may comprise a refrigerator temperature control 262 and a freezer temperature control 264. The refrigerator temperature control 262 may establish the predetermined temperature within the refrigerator compartment 202. The freezer temperature control 264 may establish the predetermined temperature within the freezer compartment 204. The refrigerator temperature control 262 and the freezer temperature control 264 may be mounted within the housing 200 such that the refrigerator temperature control 262 and the freezer temperature control 264 are accessible to the wheelchair-bound user. As non-limiting examples, the refrigerator temperature control 262 and the freezer temperature control 264 may be mounted on an interior wall or ceiling of the refrigerator compartment 202 and the freezer compartment 204, respectively, or the refrigerator temperature control 262 and the freezer temperature control 264 may be mounted on an interior wall or ceiling of a single compartment selected from the freezer compartment 204 and the refrigerator compartment 202.

The refrigeration subsystem 270 may be packaged within the housing 200. As non-limiting examples, the refrigeration subsystem 270 may be packaged in a rear wall behind the refrigerator compartment 272, in a rear wall behind the freezer compartment 274, in a space under the refrigerator compartment 276, in a space under the freezer compartment 278, or combinations thereof.

The refrigeration subsystem 270 may comprise mechanical refrigeration or solid-state refrigeration. The mechanical refrigeration may comprise a compressor, a condenser, an expansion valve, and an evaporator operating as a closed-loop system. The compressor may compress a refrigerant into a high pressure vapor, causing the refrigerant to heat up. The condenser may passively cool the refrigerant by circulating the refrigerant through a coil that is exposed to ambient room air outside of the housing 200. The refrigerant may next pass through the expansion valve that allows the pressure of the refrigerant to drop, thus cooling the refrigerant. The cooled gas may then pass through the evaporator which may absorb heat from within the housing 200. The refrigerant, now in liquid form again, may return to the compressor and the cycle may repeat.

The solid-state refrigeration may produce cooling by passing an electrical current through one (1) or more solid-state devices. As a non-limiting example, the solid state refrigeration may comprise thermoelectric coolers (TECs) that utilize the Peltier effect to create heat and cold. When the electric current passes through a plurality of P-type and N-type semiconductors within the thermoelectric coolers, one (1) side of the thermoelectric coolers heats up while the opposite side of the thermoelectric coolers cools down. The solid-state refrigeration may be oriented such that the hot side of the thermoelectric coolers is outside of the housing 200 and the cold side of the thermoelectric coolers is within the housing 200.

The housing 200 may comprise the plurality of caster wheels 280 mounted on the underside of the housing 200 to facilitate moving the invention 100. In some embodiments, the two (2) front wheels may comprise the brakes 286 that are adapted to lock the two (2) front wheels in place to prevent movement of the housing 200.

In a preferred embodiment, the housing 200, the refrigerator door 210, the freezer door 220, or combinations thereof may be made of stainless steel. A top surface 288 of the housing 200 may comprise a laminated composite surface such that the top surface 288 may be operable as a countertop.

In a preferred embodiment, the housing 200, the refrigerator door 210, the freezer door 220, the vertical compartment separator 230, or combinations thereof may comprise thermal insulation to impede the transfer of height between the interior space and the exterior air and/or between the refrigerator compartment 202 and the freezer compartment 204.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

The invention claimed is:

1. A low-profile refrigerator/freezer, comprising:

a housing having a refrigerator compartment and a freezer compartment disposed side by-side in an interior space of the housing, the refrigerator compartment refrigerates a plurality of food and beverages placed within the refrigerator compartment, the freezer compartment freezes the food placed within the freezer compartment, and the refrigerator compartment includes one or more horizontal refrigerator dividers;

a refrigerator door covering the refrigerator compartment;

a freezer door covering the freezer compartment;

a vertical compartment separator having a vertically oriented divider located between the refrigerator compartment and the freezer compartment;

a plurality of operator controls adapted to be disposed within reach of a wheelchair-bound user, the operator controls establish predetermined temperatures within the refrigerator compartment and the freezer compartment;

a refrigeration subsystem packaged within the housing; and four caster wheels disposed on each bottom corner of the housing to allow relocating the low-profile refrigerator/freezer;

wherein the refrigerator temperature control and the freezer temperature control are mounted within the housing on an interior wall or ceiling such that the refrigerator temperature control and the freezer temperature control are accessible to the wheelchair-bound user;

wherein the refrigeration subsystem is packaged in a rear wall behind the refrigerator compartment, in a rear wall behind the freezer compartment, in a space under the refrigerator compartment, and in a space under the freezer compartment;

wherein the refrigerator compartment cools the food and beverages to a temperature between 33° F. and 40° F. and the freezer compartment cools the food and beverages to a temperature below 32° F.;

wherein an at least one vertical space is operable to store a 1 Gallon container of milk and/or a bottle of juice;

wherein the refrigerator door is horizontally hingedly coupled to the housing via one or more horizontal refrigerator door hinges and the refrigerator door horizontally pivots open to provide access to a plurality of contents of the refrigerator compartment and horizontally pivot closed to retain a temperature within the refrigerator compartment;

wherein the refrigerator door includes a vertically disposed refrigerator door handle that is adapted to be grasped by the wheelchair-bound user to open or close the refrigerator door;

wherein the freezer door is horizontally hingedly coupled to the housing via one or more horizontal freezer door hinges and the freezer door horizontally pivots open to provide access to a plurality of contents of the freezer compartment and pivot closed to retain a temperature within the freezer compartment;

wherein the freezer door includes a vertically disposed freezer door handle that is adapted to be grasped by the wheelchair-bound user to open or close the horizontally hingedly freezer door; and wherein a front two caster wheels of the four caster wheels include a brake to stop the front two caster wheels for safety.

2. The low-profile refrigerator/freezer, according to claim 1, wherein the housing is a hollow and open-front rectangular prism.

3. The low-profile refrigerator/freezer, according to claim 1, wherein the one or more horizontal refrigerator dividers are operable as one or more shelves upon which the food and beverages is stored.

4. The low-profile refrigerator/freezer, according to claim 1, wherein the one or more horizontal refrigerator dividers are operable as one or more shelves, wherein the one or more shelves slides into and out of the housing for cleaning and/or access to the food and beverages stored on the at least one slide-out shelf.

5. The low-profile refrigerator/freezer, according to claim 1, wherein the refrigerator compartment includes one or more vertical refrigerator dividers having at least one vertical drawer separator, wherein the at least one vertical drawer separator includes a divider and guide for a first drawer and a second drawer.

6. The low-profile refrigerator/freezer, according to claim 5, wherein the first drawer and the second drawer are made of glass or clear plastic that does not block visibility of the food and beverages.

7. The low-profile refrigerator/freezer, according to claim 1, wherein the housing, the refrigerator door, the freezer door, or combinations thereof are made of stainless steel.

8. The low-profile refrigerator/freezer, according to claim 1, wherein the vertical compartment separator is aligned with a boundary between the refrigerator door and the freezer door such that opening the refrigerator door exposes only the refrigerator compartment and opening the freezer door exposes only the freezer compartment.

9. The low-profile refrigerator/freezer, according to claim 1, wherein the refrigeration subsystem includes mechanical refrigeration.

10. The low-profile refrigerator/freezer, according to claim 9, wherein the mechanical refrigeration includes a compressor, a condenser, an expansion valve, and an evaporator operating as a closed-loop system.

11. The low-profile refrigerator/freezer, according to claim 1, wherein the refrigeration subsystem includes solid-state refrigeration.

12. The low-profile refrigerator/freezer, according to claim 11, wherein the solid state refrigeration includes one or more thermoelectric coolers that utilize a Peltier effect to create heat and cold.

* * * * *